United States Patent [19]

Blocksome et al.

[11] 4,349,799

[45] Sep. 14, 1982

[54] SWITCHING BETWEEN RADIO FREQUENCY CIRCUITS

[75] Inventors: Roderick K. Blocksome, Robins; Sherman J. Hornbeck, Cedar Rapids; Donald R. Fee, Marion, all of Iowa

[73] Assignee: Rockwell International Corporation, El Segundo, Calif.

[21] Appl. No.: 243,014

[22] Filed: Mar. 12, 1981

[51] Int. Cl.[3] ..... H01P 1/10

[52] U.S. Cl. ..... 333/246; 200/5 D; 200/159 R; 333/105; 333/262

[58] Field of Search ..... 333/101, 105, 81 R, 333/81 A, 202, 204, 262, 246, 99 R, 173; 361/350, 351, 400, 409, 424; 200/153, 243, 5 D, 18, 16 B, 159 R, 159 B

[56] References Cited

U.S. PATENT DOCUMENTS

| | | | |
|---|---|---|---|
| 2,559,921 | 5/1951 | Greene | 200/16 |
| 2,682,592 | 6/1954 | Wilner | 200/163 |
| 2,842,637 | 7/1958 | Adams et al. | 200/104 |
| 2,946,024 | 7/1960 | Mills | 333/105 |
| 3,014,187 | 12/1961 | Sher et al. | 333/262 X |
| 3,292,075 | 12/1966 | Wenzel | 321/69 |
| 3,506,795 | 4/1970 | Schmidt | 200/159 R X |
| 4,165,497 | 8/1979 | Irons | 333/101 |
| 4,319,207 | 3/1982 | Gignoux | 333/173 |

*Primary Examiner*—Paul L. Gensler
*Attorney, Agent, or Firm*—V. Lawrence Sewell; Howard R. Greenberg; H. Fredrick Hamann

[57] ABSTRACT

An apparatus is disclosed for selecting between multiple radio frequency circuits such as low pass filters. Each of the circuits is mounted on a printed circuit board, with first and second terminals printed on the board. Each of the terminals has a raised electrical contact on it. Associated with the first terminals of the circuits is a first printed strip transmission line with raised contacts spaced along it, each contact near a corresponding contact on one of the first terminals of the circuits. A second printed transmission line is similarly arranged. External connection to the apparatus is made at one end of each of the transmission lines. To select one of the circuits, the first and second terminals of the circuit are connected to the corresponding transmission lines, by a switch which moves a resilient conducting member against the pairs of raised contacts of the transmission lines and the circuit terminals.

2 Claims, 2 Drawing Figures

SWITCHING BETWEEN RADIO FREQUENCY CIRCUITS

BACKGROUND OF THE INVENTION

This invention relates to switching between multiple radio frequency circuits, such as filters.

Selecting one circuit such as a filter, from among a number of such circuits represents a problem at radio frequencies. One of the prior art approaches has been to employ a rotary switch. The switching speed is relatively slow, because the switch must pass through all intermediate positions between an old and a new position. Moreover, the filters or other circuits must be clustered about the rotary switch in order to minimize lead lengths. This leads to packaging restrictions. The inductance in switch and wire leads to the filter inputs are difficult to control in production. Further, radiation from the switch assembly may affect other circuits. Some of these shortcomings may be alleviated by using a coaxial switch; however, these switches are expensive.

Relays have also been used in the past. These also suffer from problems with stray inductance in lead wires and radio frequency coupling to nonselected filters through interconnecting leads. Again, these problems can be alleviated by using coaxial equipment which is expensive. Further, if higher radio frequency power levels, such as one kilowatt, are required, then expensive relays are demanded in order to carry the high current.

In accordance with the present invention, there is provided an apparatus for selecting between multiple radio frequency circuits, which is fast, economical, reliable, has low loss and provides little disruption to the electrical characteristics of the circuits.

SUMMARY OF THE INVENTION

The apparatus of the invention for selecting between multiple radio frequency circuits has the circuits mounted on a printed circuit board, with each circuit having first and second terminals printed on the board. Each of the terminals has a raised electrical contact on it. Associated with the first terminals of the circuits is a first printed transmission line with raised contacts spaced along it, each contact near a corresponding contact on one of the first terminals of the circuits. A second printed transmission line is similarly arranged, having contacts associated with the second terminals of the circuits. External connection to the apparatus is made at one end of each of the transmission lines. For each of the raised contacts on one of the transmission lines and the raised contact of the associated circuit terminal, there is a switch which includes a resilient conducting member and means to push the member against the pair of raised contacts interconnecting them, or pull the conducting member away from the contacts disconnecting them.

DESCRIPTION OF A PREFERRED EMBODIMENT

Figure 1:
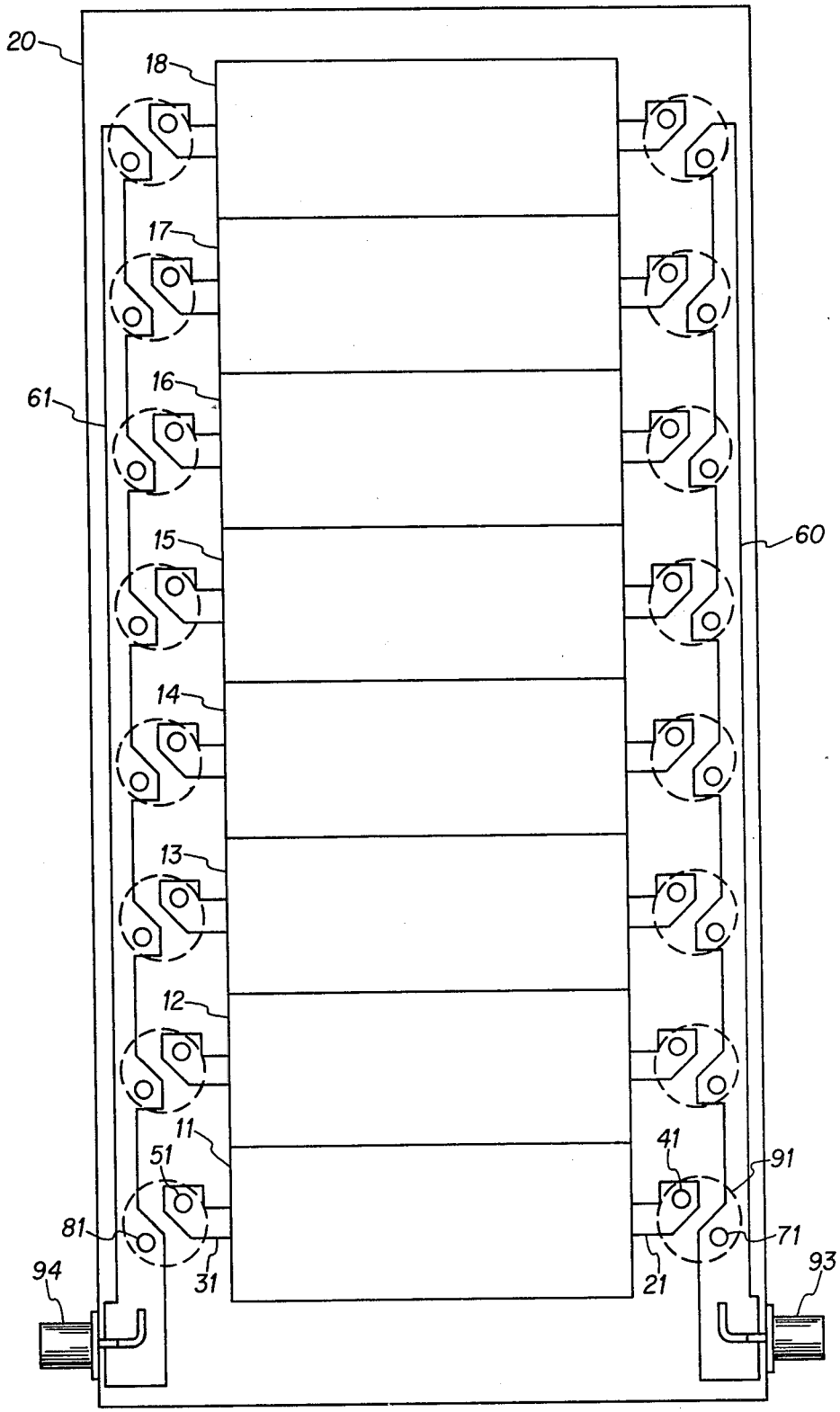
FIG. 1 is a plan view of a portion of an apparatus according to the invention, including a circuit board with circuits mounted on it.

FIG. 1 shows multiple radio frequency circuits 11 through 18, such as low pass filters, mounted on a printed circuit board 20. The filters are represented somewhat schematically as being in shielded box shaped compartments. Each circuit, such as circuit 11, has a first terminal, such as terminal 21 and a second terminal, such as terminal 31. These terminals are printed on the circuit board and are insulated from the conducting wall of the shielded compartment around the circuit. On each terminal is a raised contact such as contact 41 (FIG. 2 also) and contact 51.

Running next to the terminals of the circuits 11–18 are two transmission lines 60 and 61. One part of each transmission line is the printed conductor shown in FIG. 1 formed on the same surface of the printed circuit board as the terminals of circuits 11–18. The other part of each transmission line is formed by a conductive coating, forming a ground plane, on the entire other surface of the printed circuit board. Spaced along each transmission line are raised contacts such as contact 71 (seen also in FIG. 2) and contact 81. Each of the raised contacts is near a raised contact of one of the circuits 11–18. For example, contact 71 of transmission line 60 is associated with nearby contact 41 of circuit 11.

Figure 2:
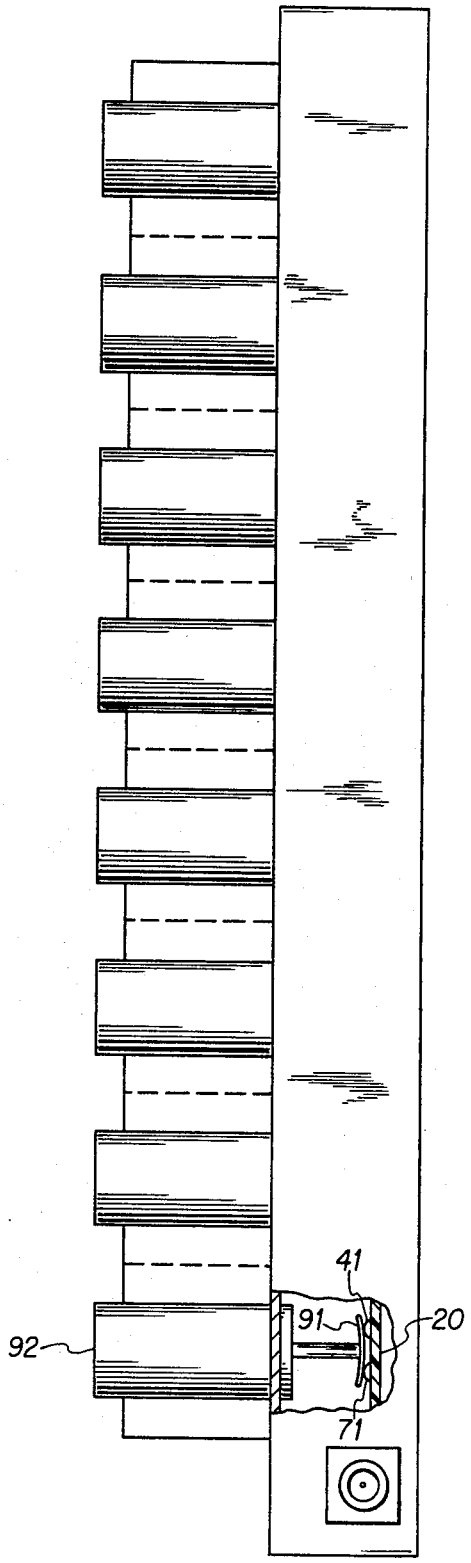
FIG. 2 is an elevation view of an apparatus according to the invention, including the portion shown in FIG. 1, and having a cutaway section showing the switching portion of the apparatus.

The broken line circles in FIG. 1 represent resilient conductive discs such as disc 91, which can be seen in elevation in FIG. 2. Each disc is mounted on the rod of a push type solenoid such as solenoid 92. The disc is insulated from the rod. When the solenoid such as solenoid 92 is activated, it pushes the disc against the raised contacts 41 and 71 connecting them. When the disc is pulled away from the contacts by the solenoid 92, the raised contacts 41 and 71 are disconnected. The resilience of the disc 91 permits small irregularities in the fabrication of the raised contacts on the circuit board, without adversely affecting the switching effectiveness.

External connection to the apparatus of FIGS. 1 and 2 is made at one end of the transmission lines through standard RF connectors 93 and 94. The other end of each transmission line is open circuited. The transmission lines are preferably fabricated with a selected impedance, such as the standard 50 ohms.

When it is desired to select one of the circuits, the two solenoids associated with the circuit are activated, connecting the terminals of the circuits to their associated transmission lines. For example circuit 11 is connected through raised contacts 41 and 71 to transmission line 60 and through contacts 51 and 81 to transmission line 61. If a different circuit is to be selected, the solenoids previously activated are deactivated, and a new pair is switched on.

The capacitance of that part of each transmission line which lies between the selected circuit and the open end of the line must be accounted for in the electrical design of the circuits. However, since the transmission line is of known characteristic impedance, the added capacitance of the line can be known and controlled to quite close limits. In the case where the circuits 11–18 are low pass filters, the percentage of the filter reactance which is external to the filter circuit itself can be minimized by arranging the circuits so that the filter with the highest cutoff frequency is nearest the open circuited end of the transmission lines. The filter with the next highest cutoff frequency is next in line and so on.

The apparatus disclosed is fast compared with a rotary switch. The components are inexpensive compared to coaxial equipment. Stray reactance and RF coupling are low, because of the particular type switching employed. In addition, the apparatus offers low loss and high power capability, as well as reliable operation.

We claim:

1. Apparatus for selecting between a plurality of radio frequency circuits, comprising:

a printed circuit board having said circuits mounted thereon, each of said circuits having first and second printed conductor terminals on said board, with the first terminals on one side of the circuits and the second terminals on the other side, each of said terminals having a raised electrical contact thereon;

first and second transmission lines, each of said transmission lines including a pair of conductor layers, each on one of the two surfaces of the circuit board, each transmission line having a plurality of raised electrical contacts spaced therealong, each of the electrical contacts along said first transmission line being spaced near a different one of the contacts of the first terminals of the circuits, and each of the contacts of the second transmission line being near a different one of the contacts of the second terminal of the circuits, with external connection to the apparatus being made at one end of each transmission line; and a plurality of interconnecting means, each associated with a different pair of the raised contacts formed by a raised contact of one the circuit terminals and the nearby transmission line raised contact, including a resilient conducting member and means for pressing the member against the associated pair of raised contacts to interconnect the contacts and for pulling the member away from the raised contacts to disconnect the contacts.

2. Apparatus for selecting between a plurality of radio frequency filters of various frequencies, comprising:

a printed circuit board having said filters mounted thereon one after another in a row, each of said filters having first and second printed conductor terminals on said board, with the first terminals on one side of the row of filters and the second terminals on the other side of the row of filters, each of said terminals having a raised electrical contact thereon;

first and second transmission lines arranged parallel with each other and separated by the row of filters, each of said transmission lines including a pair of conductor layers, one on each of the two surfaces of the circuit board, each transmission line having a plurality of raised electrical contacts spaced therealong, each of the electrical contacts along said first transmission line being spaced near a different one of the contacts of the first terminals of the filters, and each of the contacts of the second transmission line being near a different one of the contacts of the second terminals of the filters, each of the transmission lines having an open circuit at one end with external connection to the apparatus being made at the other end of each transmission line, said filters being arranged with those of the highest frequencies nearest said open circuit ends of the transmission lines, thereby to minimize the effect of the transmission lines on frequency sensitive operation of the filters; and a plurality of interconnecting means, each associated with a different pair of the raised contacts formed by a raised contact of one of the filter terminals and the nearby transmission line raised contact, including a resilient conducting disc and means for pressing the surface of the disc against the associated pair of raised contacts to interconnect the contacts and for pulling the conducting disc away from the raised contacts to disconnect the contacts.

* * * * *